US006761613B2

(12) United States Patent
Utaka

(10) Patent No.: US 6,761,613 B2
(45) Date of Patent: Jul. 13, 2004

(54) GARMENT WITH CUPWIRES

(75) Inventor: Shohei Utaka, Kasai (JP)

(73) Assignee: Utax Co., Ltd, Hyogo-Ken (JP)

( * ) Notice: Subject to any disclaimer, the term of this patent is extended or adjusted under 35 U.S.C. 154(b) by 0 days.

(21) Appl. No.: 10/273,721

(22) Filed: Oct. 18, 2002

(65) Prior Publication Data

US 2003/0119420 A1 Jun. 26, 2003

(30) Foreign Application Priority Data

Dec. 21, 2001 (JP) ..... 2001-389909

(51) Int. Cl.[7] ..... A41D 3/00
(52) U.S. Cl. ..... 450/41; 450/45
(58) Field of Search ..... 450/41, 45, 46, 450/47, 48, 51, 52, 58, 50, 49; 2/67, 69, 73, 78.1–78.3, 255–260, 262–264

(56) References Cited

U.S. PATENT DOCUMENTS 2,520,009 A * 8/1950 Kramer ..... 450/41
2,605,468 A * 8/1952 Kramer ..... 450/41
3,312,223 A * 4/1967 Wilson ..... 450/41
3,608,556 A * 9/1971 Peterson ..... 450/41
5,387,150 A * 2/1995 Terrell ..... 450/41
6,056,624 A * 5/2000 Fildan ..... 450/1

FOREIGN PATENT DOCUMENTS

JP 57-74914 10/1782
JP 54-37327 8/1979
JP 09296307 A * 11/1997 ..... 450/41
JP 2001316905 A * 11/2001 ..... 450/41

* cited by examiner

*Primary Examiner*—Gloria M. Hale
(74) *Attorney, Agent, or Firm*—J.C. Patents

(57) ABSTRACT

The present invention is related to garments with cupwires which have a hingepin provided at the front center portion of the garments, and inner ends of a left and right cupwire 3*a*, 3*b* thereof are rotatably attached to the hingepin 1. A good fit is provided for each breast due to the rotation of the cupwires, regardless of differences in the shape and size of one breast with respect to the other.

7 Claims, 7 Drawing Sheets

A

B

C

GARMENT WITH CUPWIRES

CROSS-REFERENCE TO RELATED APPLICATION

This application claims the priority benefit of Japanese application serial no.2001-389909, filed on Dec. 21, 2001.

BACKGROUND OF THE INVENTION

1. Field of the Invention

The present invention is related to garments having cupwires, including foundation garments such as brassieres and body suits, lingerie such as bra-slips, and sportswear such as leotards and swim suits.

2. Description of Related Art

In the past, such garments with cupwires (exemplified by the brassiere) were normally made up of a left and right cup connected in the middle; a foundation fabric sewn under the cups, backpieces sewn to the outer ends of the cups and extending around the wearer's torso to her back; and shoulder straps attached to the backpiece. The foundation fabric was made of a material that was not easily stretched, but the backpiece and shoulder straps had good elasticity.

The brassiere was constructed such that, because of the elasticity of the backpieces, when the brassiere was put on and fastened, it would be held tightly around the wearer's torso to her back, the cups would be held up by the elastic shoulder straps, and the under-bust would be stabilized by the foundation fabric. The bust was given added stability by underwires constructed to follow the curved lower surfaces of the cups. In such conventional brassieres, although the elasticity of the backpiece and shoulder straps generally prevented the brassiere from slipping when the wearer moved, certain body motions performed in everyday activities (such as extending the arms above the head and stretching [to reach a high shelf]) would cause the foundation fabric to slide upward, and the cupwires to shift and rise.

The reason for this was that the foundation pieces were made of a material that had very little stretch in the front, and the stability of the brassiere on a wearer relied primarily on the pulling force applied to the foundation pieces by the high elasticity backpieces and shoulder straps. A balance normally existed in the tension applied to the foundation pieces, but even the slightest disruption of this balance could cause the brassiere to slip, causing discomfort for the wearer.

This disruption of balance occurred not only during strenuous physical activity such as in sports, but could also be caused by normal body movements. This slipping could probably have been prevented by increasing the tension of the back pieces. The problem with this, however, was that a tight brassiere worn for a long period of time could reduce blood circulation and cause harmful effects such as 'cold burn.'

BRIEF SUMMARY OF THE INVENTION

The present invention was developed to solve this problem. It is an object of the invention to provide a garment with left and right cupwires rotatably attached to a hingepin provided at the front center portion of the bodice, such as to enable the garment to adapt to changes in breast shape caused by physical actions of the wearer, or by physical characteristics such as left and right breasts of different size or shape, and by so doing, to provide a garment that is comfortable to wear, and does not make the wearer feel ill at ease.

To achieve the above object, the present invention provides, as a means of solving this problem, a garment with cupwires, characterized in that a hingepin is provided at the front center portion of the garment, and inner ends of a left and right cupwire thereof are rotatably attached to the hingepin.

The invention also provides a garment with cupwires constructed as described above, wherein the left and right cupwires are attached to the hingepin by appropriately shaped through-holes provided at the inner ends of the cupwires, and wherein the attachment of left and right cupwires to the hingepin is such that they are prevented from being removed therefrom by a stopper provided at the top of the hingepin.

The invention further provides a garment with cupwires, constructed as described above, wherein the attachment of the left and right cupwires to the hingepin is such they are removable and replaceable thereon, and wherein the attachment of the left and right cupwires to the hingepin is such that they are removable and replaceable by engaging and disengaging a fastener that engages a head portion of the hingepin.

BRIEF DESCRIPTION OF THE SEVERAL VIEWS OF THE DRAWINGS

These and other features, aspects, and advantages of the present invention will become apparent with reference to the following description, claims, and accompanying drawings, where

DETAILED DESCRIPTION

Figure 1:
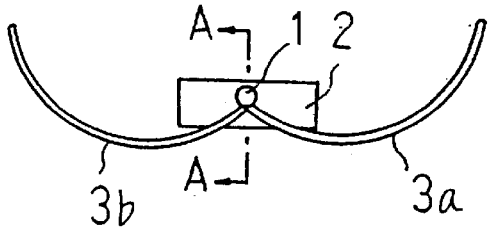
FIG. 1 is a simplified frontal view of a first embodiment of the present invention.

In the detailed description that follows, preferred modes of the present invention will be described in terms of a brassiere as a representative type of cupwire garment. Application of the invention, however, is not limited to brassieres. Although not shown in the drawings, the invention is, in fact, suitable for application in a variety of garments required to perform a shaping function for supporting, maintaining the shape of, or reshaping the bust. Such garments would include, for example, bra-slips, body suits, leotards, and swim suits.

A first embodiment of the present invention is shown in FIGS. 1–7. A hingepin 1 made of a synthetic resin or metal is provided in the front, center portion of the body of the brassiere, protruding toward the front. If a synthetic resin hingepin is used, a through-hole is provided in a body material 2 (the material used for the body of the brassiere), or a linen tape attached to the body of the brassiere. During manufacture, this body material 2, or a linen tape, is inserted between the upper and lower portions of the mold that is used to form the hingepin, before filling the mold with resin. Thus the hingepin is formed as an integral part of the body material 2 or the linen tape. If the hingepin is metal, it is installed directly in the main body of the brassiere using a hook installation tool.

Figure 4:
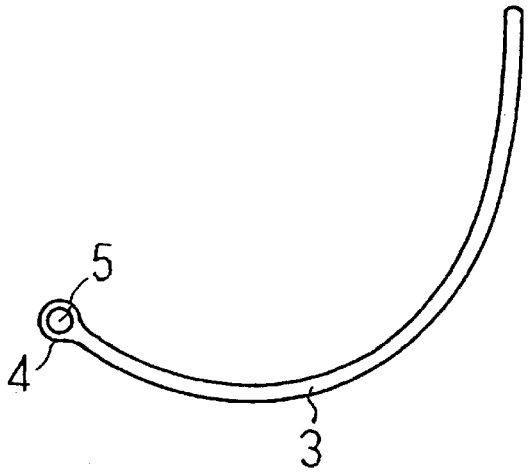
FIG. 4 is a frontal view of an example of cupwire.
Figure 5:
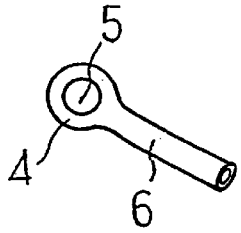
FIG. 5 shows an oblique view of a cap that is mated with the inner end of a cupwire in another example thereof.
Figure 6:
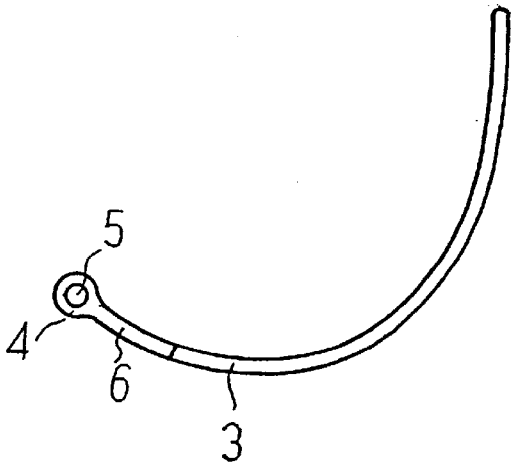
FIG. 6 is a frontal view of a cupwire with such a cap mated thereto.

Installed on the hingepin 1 are steel or plastic cupwires 3 formed to follow the curved lower portion of the bust, as depicted in FIG. 4. Provided at the inner end of each cupwire 3 is an enlarged head 4 in which is provided a round through-hole 5 that fits over the hingepin 1.

A steel cupwire 3 with a round through-hole 5 can easily be fabricated in a one-step wire pressing process, and plastic cupwires can easily be fabricated using a simple injection molding process.

Moreover, although a cupwire 3 formed from a single piece of wire was described above, (referring now to FIGS. 5 and 6) a metal or plastic cap 6 having an enlarged head 4 at one end, in which a through-hole 5 is formed, could instead be formed, and this cap 6 then fitted over the tip of the cupwire 3 at its inner end. When metal is used, these parts may be integrated into a single cupwire 3 by crimping, and when plastic is used, this can be accomplished by a fusing or cementing means.

Figure 2:
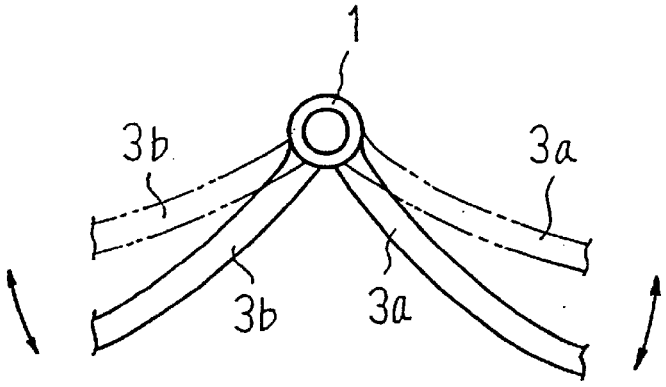
FIG. 2 illustrates cupwire rotation.
Figure 3:
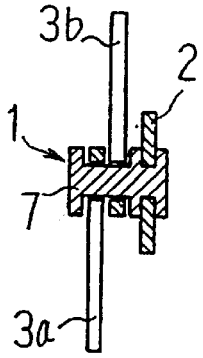
FIG. 3 is an enlarged cross-sectional view of section A—A of FIG. 1.
Figure 7:
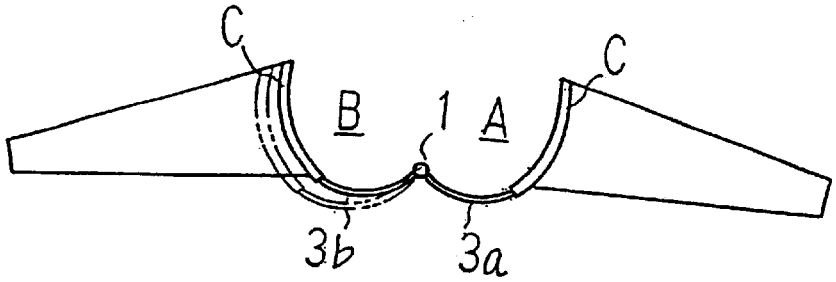
FIG. 7 is a simplified frontal view showing the operation of the cupwires of the present invention.
Figure 7:
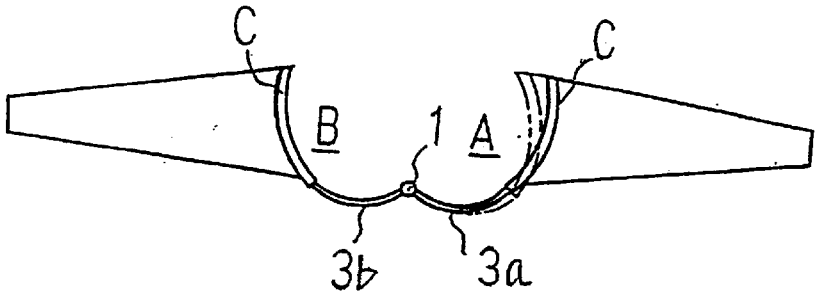
Figure 7:
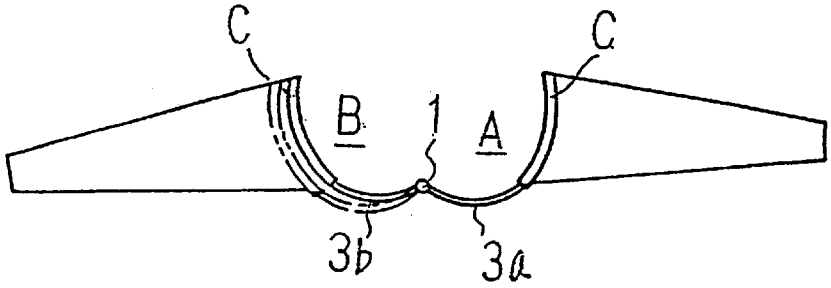

In this first embodiment, as shown in simplified form in FIGS. 1–3, through-holes 5 formed at the inner ends of left and right cupwires 3*a* and 3*b* are fitted over a hingepin 1 provided in the center of the front portion of a brassiere, such that the cupwires 3 are rotatably attached, and are prevented from coming off the hingepin 1 by a stopper 7 provided at the top of the hingepin 1. Accordingly, when the outer end portions of the right and left cupwires 3*a* and 3*b* are enclosed in cloth tubes C of the brassiere, as shown in FIG. 7, the right and left cupwires 3*a* and 3*b* will be free to rotate about the hingepin 1 at the center of rotation.

Therefore, if the left breast B happens to be larger than the right breast A such that it spreads outward to the left side, as shown in FIG. 7A, the left cupwire 3*b* will rotate outward (with the hingepin 1 at its center of rotation) to the position indicated by the double-dashed line, to conform to the shape of, and provide a good fit for, the left breast B. Also, if the side of the right breast A leans further inward than the left breast B, as shown in FIG. 7B, the right cupwire 3*a* will rotate inward (with the hingepin 1 as its center of rotation) to the position indicated by the double-dashed line, to conform to the shape of (provide a good fit for) the right breast A.

Also, if participation in sports or similar activity causes the shape of the left breast B to experience a flow of movement toward left side as shown in FIG. 7C, then the left cupwire 3*b* will rotate outward (with the hingepin 1 as its center of rotation) to the position indicated by the double-dashed line, to conform to the flow, thus maintaining the shape of, and providing a good fit for, the left breast B.

Figure 8:
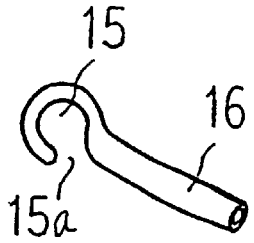
FIG. 8 shows an oblique view of a cupwire cap used in a second embodiment of the present invention.
Figure 9:
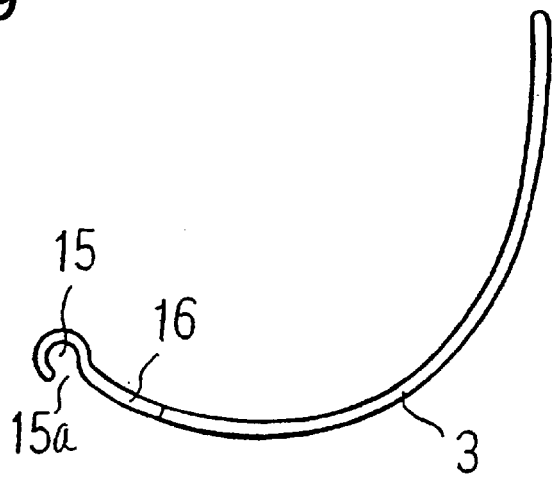
FIG. 9 shows a frontal view of a cupwire with such a cap mated thereto.
Figure 10:
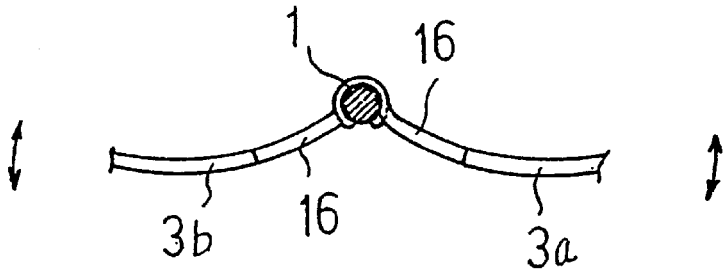
FIG. 10 is a simplified partial frontal view showing cupwires with caps of this type attached to a hingepin.

Next, a second embodiment of the present invention will be described with reference to FIGS. 8–10. In the first embodiment described above the cupwires 3 rotatably attached to the hingepin 1 were prevented from coming off by a stopper 7 provided at the top of the hingepin 1. In this second embodiment, however, the brassiere is configured so that the cupwires 3 can be easily attached and removed.

That is, the main differences between the second and first embodiment are that (1) the second embodiment has a plastic or metal cap 16 having a circular hook-shaped through-hole 15 at its end, instead of a circular through-hole 5; and (2) a catch is provided on the hingepin 1. The shape, size and material of the cupwires 3 and cap 16 are the same as in the first embodiment.

In the second embodiment of the present invention as described above, to attach a cupwire 3 to the hingepin 1, a cut-out 15*a* of a circular hook-shaped through-hole 15 of a cap 16 of a cupwire 3 is positioned adjacent to the catch on the hingepin 1 (not illustrated) and pressed inward against the hingepin. In this manner, a cupwire can be mated with the hingepin 1. A brassiere having cupwires 3 (3*a* and 3*b*) attached to the hingepin 1 in this manner will function the same as described above in the examples of operation of the brassiere of the first embodiment (as illustrated in FIGS. 7A–7C), thus to accommodate left and right breasts of different size or shape, and breast changes caused by body motion.

To remove a cupwire 3, the reverse of the attachment operation is performed. That is, a cupwire can be removed from the hingepin 1 by positioning the cut-out 15*a* adjacent to the catch on the hingepin 1 (not illustrated) and pulling it away from the hingepin. Therefore, according to the present embodiment, the cupwires 3 can be removed prior to laundering the brassiere, to avoid distortion and bending, thus preserving their proper shape over an extended period of time. Also, if the existing cupwires do not provide optimum fit and function because of individual differences in breast size, shape, or separation, they can be replaced with cupwires that fit better.

Figure 11:
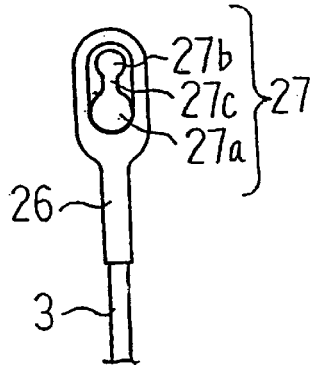
FIG. 11 is a simplified frontal view of a cupwire cap used in a variation of the second embodiment.
Figure 12:
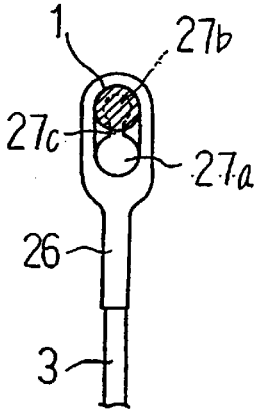
FIG. 12 shows a simplified frontal view of such a cap as it would appear when properly mated with a hingepin.
Figure 13:
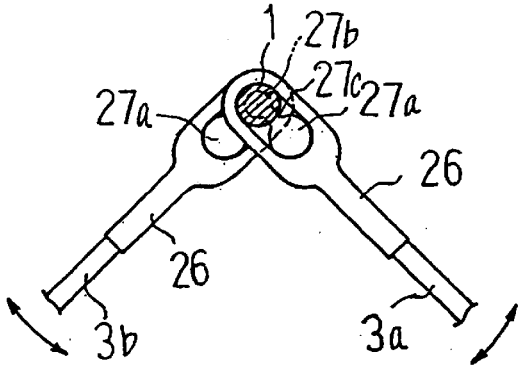
FIG. 13 is a simplified frontal view showing how cupwires having such caps rotate when mated with a hingepin.

A variation of the second embodiment is shown in FIGS. 11–13. Here, a cap 26 is configured such that it can be slid upward and downward (as viewed in the drawing) for removing the cupwire 3 from, or attaching it to, the hingepin 1.

That is, a cupwire 3 is made with a cap 26 of metal or plastic. The forward end of the cap 26 is formed into a flattened oval shape, with an oblong slot 27 formed in it. The oblong slot 27 is formed as a continuous opening having a large diameter hole 27*a* at its base end, a small diameter hole 27*b* at its forward end, and a narrow oblong opening 27*c* that interconnects the two holes. The form and material of the hingepin 1 and the cupwire 3 (of which the cap 26 is an integral part) are the same as in the above embodiments.

To attach thus configured cupwires 3 (3*a* and 3*b*) to a hingepin 1, the large diameter hole 27*a* of the cap 26 is placed over the hingepin 1 (provided at the front center of a brassiere) such that that hingepin 1 passes through it. Then, with the catch of the hingepin 1 (not illustrated) aligned with the narrow oblong opening 27*c*, the cap 26 is slid downward (as viewed in the drawing) until the small diameter hole 27*b* is engaged with the hingepin 1. A brassiere having cupwires 3 attached in this manner functions the same as the brassiere in the embodiment described above.

To remove a cupwire 3, the reverse of the attachment operation is performed. That is, the cupwire is removed from the hingepin 1 by aligning the narrow oblong opening 27*c* with the catch on the hingepin 1 (not illustrated) and sliding the cap 26 upward (as viewed in the drawing) until its large diameter hole 27*a* is lined up with the hingepin 1, where it can then be removed. Thus because the small diameter hole 27*b* may be easily disengaged from the hingepin 1 by sliding the cap 26, the present embodiment achieves the same operational effect as the embodiment described earlier.

Figure 14:
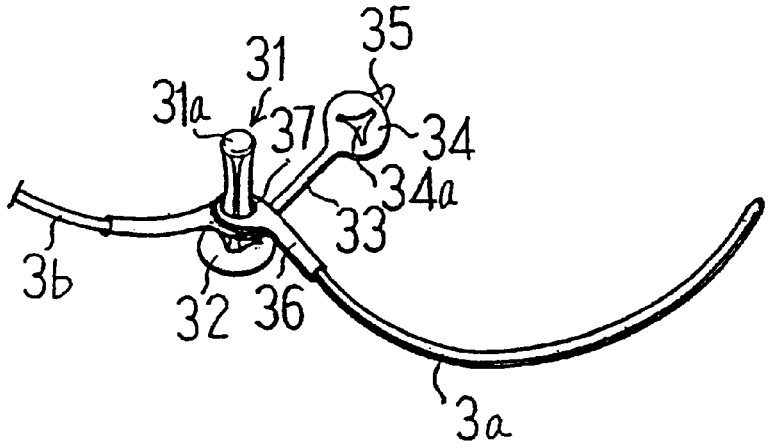
FIG. 14 is a simplified oblique view showing cupwires of a third embodiment of the present invention mated with a hingepin.
Figure 15:
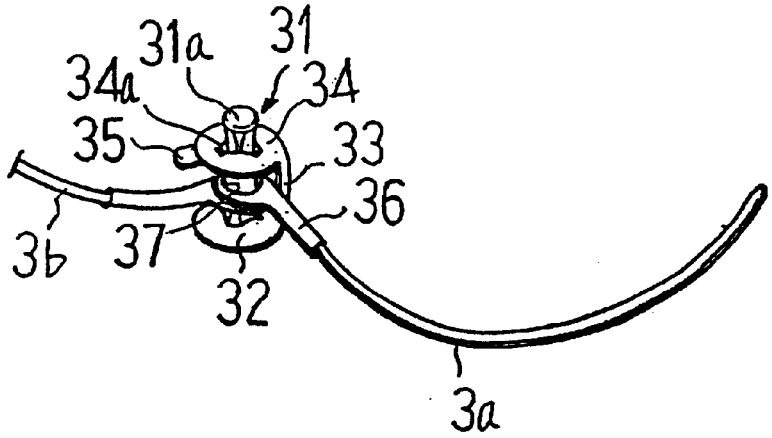
FIG. 15 is a simplified oblique view showing the above cupwires as they would appear when in use.

A third embodiment of the present invention is shown in FIGS. 14 and 15. In the above second embodiment, the cupwires 3 were made removable and replaceable on the hingepin 1 either through operation of a circular hook-shaped through-hole 15 formed at the inner end of each of the left and right cupwires 3*a* and 3*b*, or an oblong slot 27 having formed therein a large diameter hole 27*a* and a small diameter hole 27*b* interconnected by a narrow oblong opening 27*c*. In this third embodiment, however, a fastener 34 that can be fitted over the enlarged head portion 31*a* of a synthetic resin hingepin 31 is provided such that the cupwires 3 can be attached or removed by fastening the fastener 34 onto, or removing it from, the hingepin 31.

The synthetic resin hingepin 31 is attached as an integral part of a linen tape or the material of the brassiere body by the same means as that described for the first embodiment; i.e., the hingepin 31 is constructed such that it forms a single integrated unit with a bottom plate 32, a band 33 extending from the bottom plate 32, and a fastener 34 provided at the outer end of the band 33. Also, provided in the center of the fastener 34, is a slit cut 34*a* that mates with the enlarged head 31*a* of the hingepin 31. Also, a grip 35 is provided on the fastener 34.

To attach left and right cupwires 3*a* and 3*b* to a thusly configured hingepin 31, through-holes 37 formed in the caps 36 of the cupwires 3*a* and 3*b* are placed over the hingepin 31 so that the hingepin 31 passes through the through-holes 37. Then, the grip tab 35 of the fastener 34 is used to pull the fastener 34 down over the enlarged head 31*a* of the hingepin 31 until it protrudes through a slit-cut 34*a* in the fastener 34, thus retaining the fastener 34 on the hingepin 31.

To remove the left and right cupwires 3*a* and 3*b*, the grip tab 35 is pulled upward until the enlarged head 31*a* slips through the slit-cut 34*a*, thus releasing the fastener 34, which enables the left and right cupwires 3*a* and 3*b* to be removed. In this embodiment, then, the left and right cupwires 3*a* and 3*b* may be attached and removed by fastening and releasing the fastener 34. This provides convenience in that the cupwires 3*a* and 3*b* may be attached and removed without taking off the brassiere.

Figure 16:
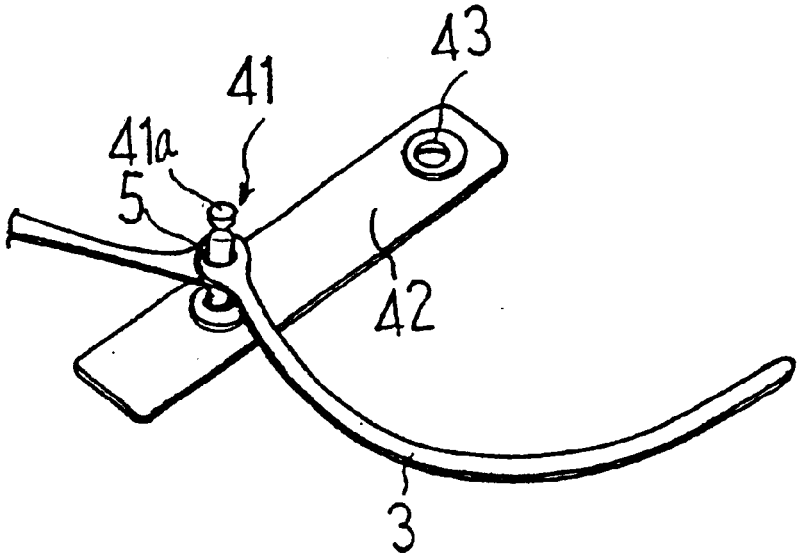
FIG. 16 is an oblique view showing cupwires installed on a different hingepin of the third embodiment.
Figure 17:
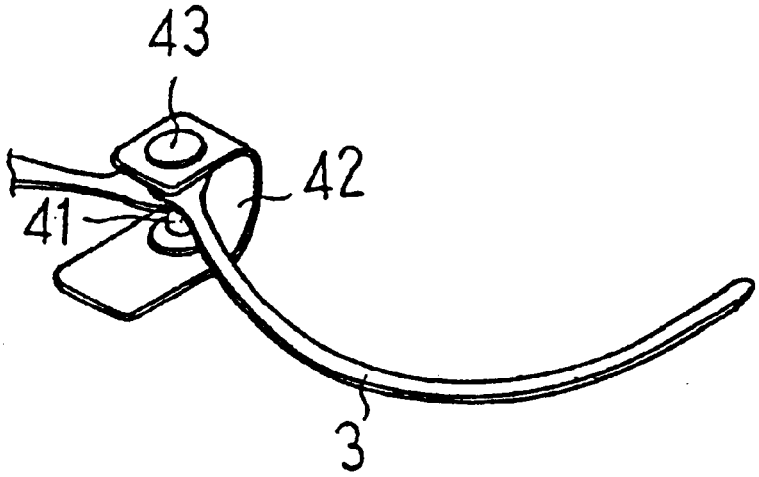
FIG. 17 is a simplified oblique view showing the above cupwires and hingepin as they would appear when in use.

Shown in FIGS. 16 and 17 is a variation of the third embodiment in which the synthetic resin hingepin 41 has a catch at its upper end. This hingepin 41 is formed as an integral part of a linen tape 42 by the same means as that described for the first embodiment. Also provided in the linen tape 42, at a given distance from the hingepin 41, is a fastener 43 that can be fastened to, and removed from, a hingepin head 41*a*.

To attach a cupwire 3 to a thusly configured hingepin 41 (i.e., a hingepin 41 of a linen tape 42 that is sewn into the front, center of a brassiere), the hingepin 41 is inserted through the circular through-hole 5 at the inner end of the cupwire 3, after which the linen tape 42 is folded back over itself, and the fastener 43 is fastened to the hingepin head 41*a*. To remove the cupwire 3 from the hingepin 41, the fastener 43 is disengaged from the hingepin head 41*a* by pulling on the end of the linen tape 42, after which the cupwire 3 may be removed. Therefore, as was the case in the above embodiment, according to the present embodiment as well, the cupwires 3 can be attached and removed by fastening and unfastening the fastener 43, without having to take off the brassiere.

A number of advantages, then, are provided by the present invention. According to a first and second aspect of the invention described above, regardless of differences in the shape and size of one breast with respect to the other, because the cupwires of the garment can rotate and reshape as required to accommodate these differences, a good fit is provided for each breast. Also regardless of changes in the shape of the bust that might occur due to movements of the wearer's body, because the cupwires can rotate as required to accommodate these changes, the garment feels natural on the wearer, and it can therefore be worn comfortably for long periods of time.

Also, according to a third aspect of the invention described above, cupwires are prevented from becoming disengaged from a hingepin by a stopper that is provided at the top of the hingepin. This provides an advantage in addition to those provided by the first and second aspects of the invention in that the cupwires in a garment such as a brassiere, etc., are prevented from inadvertently becoming disengaged from the hingepin while the garment is being worn.

In addition, according to a fourth and fifth aspect of the present invention, the cupwires are made so that they can be removed from the hingepin and put back on. This provides advantages in addition to those provided by the first and second aspects of the invention in that the cupwires can be removed from the garment before laundering it to prevent their becoming misshapen during the laundering process, and in that it allows for selection of cupwires that provide the best possible fit. Removal of cupwires also makes a garment easier to fold for packing or storage.

The foregoing describes preferred embodiments of the present invention. The present invention, however, is not limited to the above embodiments, and a number of design modifications could be made such that the object of the invention would be achieved, and without deviating from the scope of the invention as defined by the following claims.

What is claimed is:

1. A garment with cupwires, characterized in that a hingepin protruding forwardly is provided at a front center portion of the garment, which hingepin being integrally moulded by impregnated synthetic resin in to a piece of linen tape or garment body, a through-bore formed at each inner end of left and right cupwires into which the hingepin is inserted thereby rotatably connecting the left and right cupwires, a fastener being detachably fit to a head portion of the hingepin so that the left and right cupwires can be separated.

2. A garment with cupwires as recited in claim 1, wherein the left and right cupwires are attached to the hingepin by appropriately shaped through-holes provided at the inner ends of the cupwires.

3. A garment with cupwires as recited in claim 1, wherein the attachment of left and right cupwires to the hingepin is such that they are prevented from being removed therefrom by a stopper provided at a top of the hingepin.

4. A garment with cupwires as recited in claim 2, wherein the attachment of left and right cupwires to the hingepin is such that they are prevented from being removed therefrom by a stopper provided at the a top of the hingepin.

5. A garment with cupwires as recited in claim 1, wherein the attachment of the left and right cupwires to the hingepin is such that they are removable and replaceable thereon.

6. A garment with cupwires as recited in claim 2, wherein the attachment of the left and right cupwires to the hingepin is such that they are removable and replaceable thereon.

7. A garment with cupwires as recited in claim 4, wherein the attachment of the left and right cupwires to the hingepin is such that they are removable and replaceable by engaging and disengaging a fastener that engages a head portion of the hingepin.

* * * * *